United States Patent [19]

Müller

[11] Patent Number: 4,813,969

[45] Date of Patent: Mar. 21, 1989

[54] PROCESS OF MANUFACTURING SYNTHETIC HAIR FOR WIGS, HAIR PIECES, ETC.

[76] Inventor: Klaus Müller, Ringlehauserallee 16, Laupheim, Fed. Rep. of Germany, 7958

[21] Appl. No.: 769,719

[22] Filed: Aug. 27, 1985

[30] Foreign Application Priority Data

Aug. 30, 1984 [DE] Fed. Rep. of Germany ..... 3431886

[51] Int. Cl.[4] ..... D06M 11/14

[52] U.S. Cl. ..... 8/115.51; 8/115; 8/115.69

[58] Field of Search ..... 8/115.51, 115.69, 127.51, 8/115

[56] References Cited

U.S. PATENT DOCUMENTS 4,332,585 6/1982 Minemura et al. ..... 8/115.69

OTHER PUBLICATIONS

Devries, German-English Science Dictionary, 3rd Ed., McGraw-Hill (1959).

*Primary Examiner*—Paul Lieberman
*Assistant Examiner*—John F. McNally
*Attorney, Agent, or Firm*—Paul H. Gallagher

[57] ABSTRACT

The invention deals with a process for production of synthetic hairs for use in wigs, hair pieces, etc. While the natural appearance of synthetic hair is retained, the synthetic hair has a high thermal resistance. In the process, individual hair is given a diffuse light refraction by altering its structure surface, by means of chemically disturbing the surface. The process is so conducted that the surface of a single filament polyester fiber is disturbed by means of a corrosive alkaline lye, in which the solution of about 20 g/l of natrium hydroxide works into the fiber at a temperature of 96°C.-100° C.

3 Claims, 3 Drawing Sheets

PROCESS OF MANUFACTURING SYNTHETIC HAIR FOR WIGS, HAIR PIECES, ETC.

FIELD OF THE INVENTION

The invention relates to a process for manufacturing synthetic hair, for use in wigs, hair pieces, etc.

Synthetic hair filaments that have been used heretofore for the purpose stated, and for hair replacement, while they resemble natural hair from the standpoint of light reflection, they did have the disadvantage of diffuse light reflection. The disadvantage of those hair filaments resulted from the fact that they were made of PVC material or of Modacryl, which have a low thermoplastic distortion point. Because of this, a disadvantage was that the hair became slick, and the hair style became unsightly, even resulting from body temperature, and from hot showers, and use in tropical lands. It was, for example, hardly possible to have a good style of hair in countries where the predominant temperatures were over 30° C., and in no case was it possible to use such hair pieces or wigs of the kind mentioned in a sauna.

In connection with synthetic materials used in the kinds of hair heretofore known, special instrumentalities were required for handling the hair style because natural hair tolerates much higher temperatures in drying the hair of for example 160° C. to 180° C., while the previously known synthetic materials had a melting point of 140° C. and the thermoplastic distortion began at around 24° C.

Synthetic materials of higher melting temperatures could not be used in making artificial hair, because it was impossible to give that kind of hair a natural sheen. Such hair filaments resembled fishing line, that is, they were translucent and behaved very unnaturally. Even if those materials were well pigmented, nevertheless in strong sunight the fishing line character emerged, that is, one could see at a distance that it was synthetic hair.

The synthetic materials heretofore known, referred to above, PVC and Modacryl, were, in their structure, so constituted that they reflected light similarly to natural hair.

A main purpose of the present invention is to provide synthetic hair that, while keeping the natural appearance possess high thermal tolerance.

The present invention overcomes such disadvantages by altering the structure and/or surface of the synthetic hair so that the individual hair filaments will be given a diffuse light refraction, for example, by chemically disturbing or disrupting the surface thereof.

The present invention provides an entirely new method to produce the end results mentioned. Now it is possible to use synthetic materials for hair that have high temperature tolerance, while still showing the fishing line character, under the influence of light. The invention provides for altering the surface and/or structure of the synthetic materials and thereby combine the advantages of the tolerance to higher temperatures, that is, the permanence of the hair style with the advantage of the natural sheen of the hair pieces. As a result there is a close similarity in appearance between the light reflection of the natural hair and the synthetic hair, that is, the two cannot be distinguished. This similarity also exists in different light sources, for example, in natural or artificial light.

Another feature of the invention is that the process can be so conducted as to so disturb or disrupt the surface of a single filament of polyester fiber, for example, by a caustic soda solution, the process in this case utilizing a solution of about 20 g/l sodium hydroxide works into the fiber at a temperature of about 96° C.–100° C.

In this feature of the process, the polyester fiber so chemically treated, produces a diffuse light refraction that corresponds exactly to that of natural hair.

Another feature of the invention is that the surface of a single filament polyamide fiber is disrupted or disturbed by for example means of an acid treatment.

In this step, an expert operator can use known processes in order to obtain this diffuse light refraction character, which is also present in natural hair. Additionally, he can conduct this process so that a non-uniform light refraction also results as exists in connection with natural hair. Accordingly, an operator can utilize these lyes or acids of different temperatures, as well as of different compositions.

Another feature of the invention is that the surface of the synthetic hairs may be disturbed or disrupted by means of known mechanical processes, for example polishing, rubbing, etc.

These mechanical processes can be utilized during the production of the fiber, and in this case also a reliable diffuse light refraction can be obtained, similar to that in natural hair.

Another feature of the invention is the surface of the synthetic hair filaments can be so disrupted or disturbed by means of a laser beam by means of generation of varying melting rays.

The process also provides for operating in a running process, by means of so disrupting or disturing different portions of the surfaces, producing different refraction characteristics, to produce the light refraction effect found in natural hair.

The step of the process in which the structure is altered, produces enclosures in the hair, such for example as air holes, which alter the character of the light refraction. This step produces a synthetic hair which is very close to natural hair. Natural hair has a scale layer. This scale layer is produced in the manner just stated, so that the light refraction is identical with or similar to that of natural hair. In the process of the invention, it is also possible to disturb or disrupt the surface of the synthetic hair filaments in the production thereof by means of correspondingly manipulating the spinning nozzle through which the hair is produced.

The spinning nozzle can be directed or trained so that it produces a disrupted or disturbed surface, or forms a scale that builds in proportion to the training of the outlet of the nozzle.

The light refraction can be altered so that the synthetic hair possesses a stratification, for example, polyacrylic.

It is possible to use this stratification for a completely different purpose, that is, independent of whether a person produces the hair of a synthetic material that has a lower or higher temperature tolerance, and additionally, it is within the scope of the invention that the stratification of synthetic hair of a low melting point, can be utilized as heat insulation.

In the use of the process of the invention, a person can, to an extent, improve the filaments of the previously known hair found on the market by providing heat insulation, while retaining the same light refraction. Additionally, through the stratification with a heat resistant synthetic material, this synthetic hair can be used in high temperature with the same thermal qualities as other synthetic materials.

The drawings represent construction examples of hair filaments produced by the process of the invention.

Figure 2:
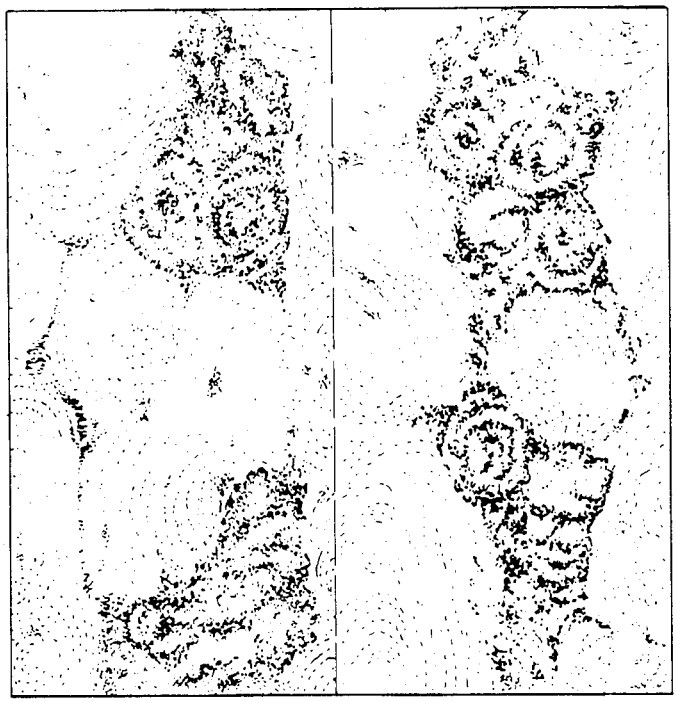
FIG. 2 represents pigments, such as exist in natural hair.

Referring in detail to the drawings, FIG. 2 shows how, for example, by means of introducing of air holes or enclosures, an effect similar to that of actual hair is attained. By means of these process steps, a person can correspondingly imitate the hair structure of different peoples. Upon determining the surface of the hair of, for example, a Japanese or Chinese, the process can be utilized to produce that same surface in the synthetic hair.

Figure 1:
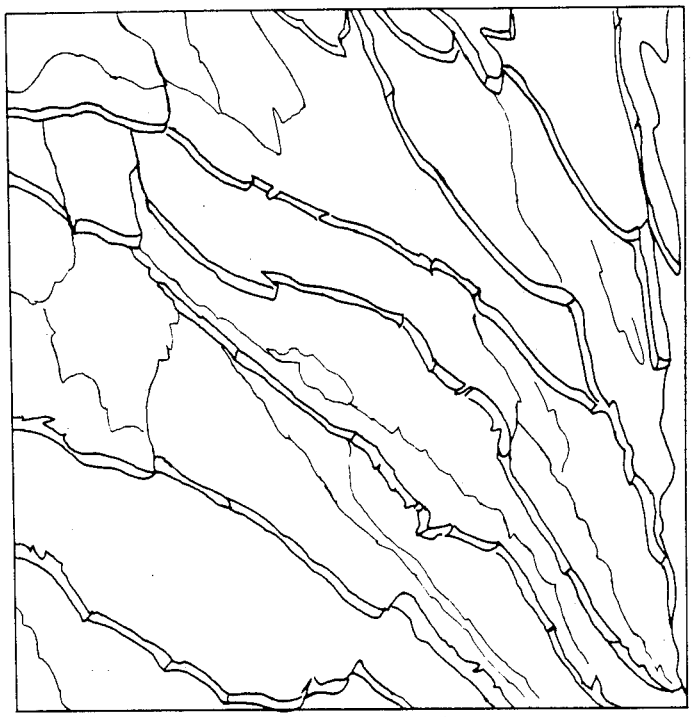
FIG. 1 shows the surface of a synthetic hair having a surface disturbed or treated for the purpose of diffuse light refraction.
Figure 3:
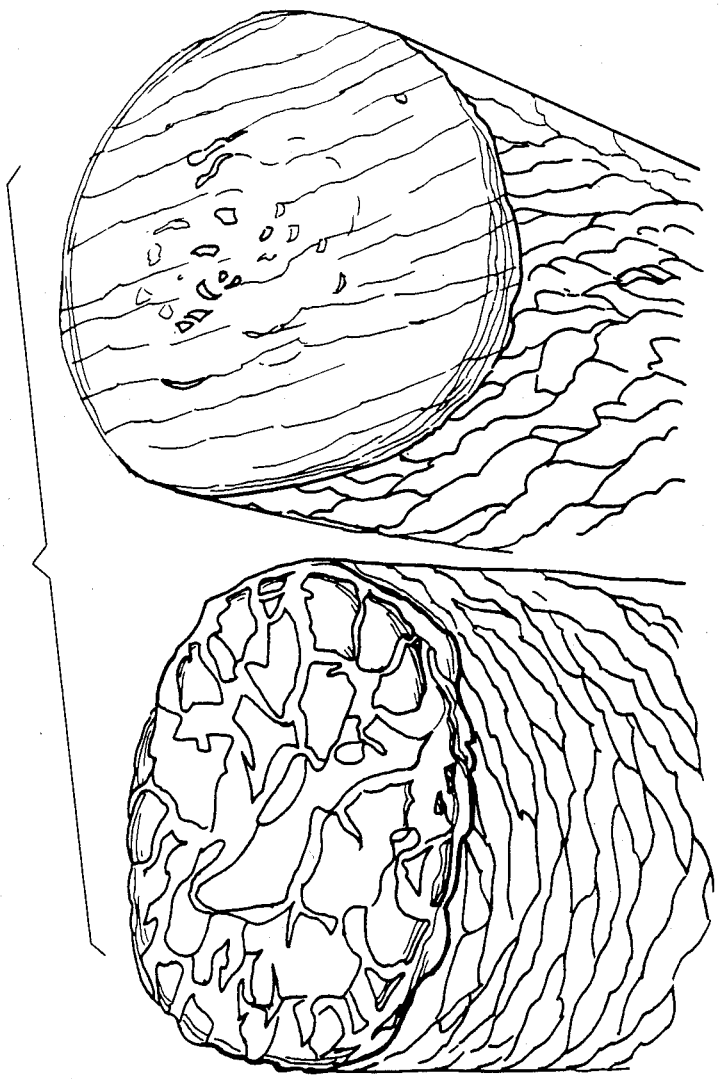
FIG. 3 represents a scale on the surface of the hair.

FIG. 3 shows hair filaments having a scale on the surface including the disturbance or disruption represented in FIG. 1.

I claim:

1. In a process of manufacturing synthetic hair filaments for use in wigs and hair pieces the improvement comprising providing the surface of the individual synthetic polymer filaments with an increased diffuse light refraction characteristic by forming individual filaments essentially round in cross-section without material differences in diameters thereof so that the surface is convex essentially continuously therearound in circumferential direction by applying an aqueous solution containing about 20 grams/liter sodium hydroxide.

2. The process according to claim 1 wherein said filaments are polymers selected from the group consisting of polyesters and polyamides.

3. The process according to claim 1 conducted at a temperature of 96°–100° C.

* * * * *